US006572098B2

(12) United States Patent
Schaefer et al.

(10) Patent No.: US 6,572,098 B2
(45) Date of Patent: Jun. 3, 2003

(54) SHEET DIVERTER FOR COLLATING SIGNATURES AND A METHOD THEREOF

(75) Inventors: Karl P. Schaefer, Brookfield, WI (US); Ingermar S. d'Agrella, Sussex, WI (US); Eric L. Kuhne, Big Bend, WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/972,662

(22) Filed: Oct. 8, 2001

(65) Prior Publication Data

US 2002/0074721 A1 Jun. 20, 2002

Related U.S. Application Data

(63) Continuation of application No. 09/222,750, filed on Dec. 29, 1998, now Pat. No. 6,302,392.

(51) Int. Cl.[7] ..... B65H 29/00

(52) U.S. Cl. ..... 271/186; 271/283; 271/302; 271/272

(58) Field of Search ..... 271/283, 279, 271/303, 186, 272, 305, 302

(56) References Cited

U.S. PATENT DOCUMENTS

| | | | |
|---|---|---|---|
| 2,164,436 | A | 7/1939 | Waters |
| 4,373,713 | A | 2/1983 | Loebach |
| 4,486,015 | A | 12/1984 | Takahashi |
| 4,729,282 | A | 3/1988 | Kasdorf |
| 4,811,641 | A | 3/1989 | Muller |
| 4,893,534 | A | 1/1990 | Kobler |
| 4,930,383 | A | 6/1990 | Kobler |
| 4,948,112 | A | 8/1990 | Sato et al. |
| 5,112,033 | A | 5/1992 | Breton |
| 5,228,681 | A | 7/1993 | Arnold |
| 5,615,878 | A | 4/1997 | Belanger et al. |
| 5,702,100 | A | 12/1997 | Novick et al. |
| 5,992,842 | A | 11/1999 | Dickhoff |
| 6,038,424 | A | 3/2000 | Nakagawa |
| 6,116,595 | A | 9/2000 | d'Agrella |

*Primary Examiner*—Christopher P. Ellis
*Assistant Examiner*—Richard Ridley
(74) *Attorney, Agent, or Firm*—Michael Best & Friedrich LLP

(57) ABSTRACT

Provided is a sheet diverter for directing signatures moving in serial fashion along a diverter path to one of a plurality of collation paths. The sheet diverter includes a pair of diverter rolls for directing a signature to one of the plurality of collation paths and a diverter wedge for deflecting the signature to a selected one thereof. The diverter wedge is positioned between the diverter rolls so as to reach high into the diverter path thereby providing increased support to the signature as it travels from between the diverter rolls to the diverter wedge. The diverter rolls are permitted to intermesh with the diverter wedge so as to allow the diverter wedge to be so positioned.

21 Claims, 8 Drawing Sheets

SHEET DIVERTER FOR COLLATING SIGNATURES AND A METHOD THEREOF

REFERENCE TO RELATED APPLICATIONS

This is a continuation application of U.S. application Ser. No. 09/222,750, filed Dec. 29, 1998, now U.S. Pat. No. 6,302,392 entitled SHEET DIVERTER FOR COLLATING SIGNATURES AND A METHOD THEREOF.

FIELD OF THE INVENTION

The present invention relates, generally, to sheet diverters for directing sheets moving in serial fashion along a path to one of a plurality of collation paths and, more particularly, to a high speed sheet diverter of the foregoing kind for collation of printed signatures to be used in the binding of a publication such as a magazine or a newspaper. The present invention further relates to an improved diverter assembly for collating sheets, such as signatures, from a high speed printing press. Specifically, the present invention provides a sheet diverter with diverter rolls and a diverter wedge positioned therebetween, the function of which is to allow for faster operating machine speeds with fewer jams and, at the same time, to improve the collation process such that the quality of signatures is improved as the signatures move along one of a plurality of collation paths.

BACKGROUND OF THE INVENTION

Sheet diverters may range from the collating apparatus associated with an office copier, to sheet or web handling devices employed in the manufacture of paperboard articles, to sheet diverters specifically adapted to collate signatures to be used in binding or otherwise assembling books, magazines or newspapers. Each of these environments presents a somewhat different challenge in designing an efficient diverter or collator, but the same objective applies to the entire class of apparatus, namely, accurately routing selected flexible webs or ribbon sections along a desired collating path to achieve a desired order.

In the printing industry, an image is repeatedly printed on a continuous web or substrate such as paper. The ink is dried by running the web through curing ovens. In a typical printing process, the continuous web is subsequently slit (in the longitudinal direction which is the direction of web movement) to produce a plurality of continuous ribbons. The ribbons are aligned one on top of the other, folded Longitudinally, and then cut laterally to produce a plurality of multi-paged, approximately page length web segments, termed signatures. A signature can also be one printed sheet of paper that has or has not been folded. It is often desirable to transport successive signatures in different directions or paths. In general, a sheet diverter operates to route a signature along a desired one of a plurality of paths.

A sheet diverter in a folder towards the end of a printing press line must be operable at the high speeds of the press line, typically in excess of 2,000–2,500 feet per minute (fpm). It is desirable to run both the press, folder and other equipment in the printing press line at the highest speed possible to produce as many printed products as possible in a given amount of time. However, the physical qualities of printed paper or similar flexible substrates moving at a high rate of speed can result in undesirable whipping, dog-earring, tearing, smearing of the ink, or bunching of the substrate. Additionally, impact between the leading edge of a signature and a diverter wedge may result in the leading edge of the signature being dented or dog-eared or damaged in other ways. Moreover, the trailing edge of a signature may slap against the top edge of a diverter wedge, resulting in tears, dog-ears or other damage to the trailing edge. Damaged signatures may be of reduced or unacceptable quality and may also lead to jams in the folder, resulting in downtime, repair expense and much wasted paper.

Another problem which occurs when operating a press and a folder at high speeds is that signatures may be routed to an undesired one of a plurality of collation paths. As the leading edge of a signature approaches the apex of a diverter wedge, depending on the stiffness of the signature and due to the relationship between the diverter and the diverter wedge, the signature may be delivered to the wrong side of the diverter wedge thereby sending the signature down the wrong collation path. This leads to jams in the folder causing delays and expense.

Yet another problem when operating a printing line at high speeds concerns ink offset in the diverter. As a signature impacts a diverter wedge, non-dried ink may transfer to the surface of the diverter wedge. As successive signatures contact the diverter wedge, the ink transferred to the diverter wedge may undesirably pass to the other signatures. The greater the impact of the signatures against the diverter wedge, the greater the likelihood of ink offset.

Many of the foregoing defects become more prevalent above certain speeds of the printing press and folder. For example, such defects may occur when the press is run at speeds greater than 2,500 fpm, but may not occur when the press is run at a slower speed, for example, 2,200 fpm. As printing press speed capabilities have increased, it has become increasingly important to provide a system which allows for individual signatures to be directed down any one of a plurality of selected collation paths without damaging the leading or trailing edge of each signature or causing jams.

U.S. Pat. No. 4,373,713 discloses a diverter mechanism placed in a path of a stream of cut sheets comprising a pair of rotary diverters with raised cam surfaces used to divert and guide the sheets. A tapered guide has a pair of diverging guide surfaces and has its upstream tapered end interposed between the rotary diverters with raised cam surfaces and diverging tapes.

A sheet diverter for signature collation and a method thereof is described in U.S. Pat. No. 4,729,282, assigned to Quad/Tech, Inc., of Pewaukee, Wis., and is hereby incorporated by reference. The '282 patent discloses a sheet diverter including an oscillating diverter guide member that directs successive signatures to opposite sides of a diverter wedge. As set forth in the '282 patent, the diverter design disclosed in the '713 patent is not viewed as workable in light of the high speeds sought to be attained nor is it seen to be particularly reliable in reducing jamming tendencies which are expected to arise in these settings.

SUMMARY OF THE INVENTION

Diverting devices are used in the printing industry to divert individual signatures along alternating paths in the folder part of a printing press line. Because the diverting operation has a slow processing velocity in relation to the rest of the line, the industry seeks to speed up this operation while reducing damage to the signatures and avoiding jams.

There is a need for a sheet diverter that is capable of operating at high speeds, e.g., in excess of 2,500–3,000 fpm and above, and yet also capable of providing a signature that is acceptable in quality. What is also needed is a sheet diverter for use in the printing industry such that the sheet diverter improves the collation process of printed signatures to prevent or minimize damage to the signatures as the signatures move along one of a plurality of collation paths to increase the quality of each signature, allow for greater operational speeds and reduce downtime and repair expenses associated with jams in a folder. What is further needed is a sheet diverter for use in a high speed printing press line which is designed to prevent or minimize the transfer of non-dried ink to a diverter wedge of the sheet diverter thereby enhancing the overall quality of the printed signatures.

In one embodiment of the present invention, a diverter assembly for diverting signatures from a diverter path to a desired one of a plurality of collation paths is provided. A pair of spaced apart, rotating diverter rolls have respective travel paths which define a common swipe path for the diverter rolls. A diverter wedge which separates the plurality of collation paths is positioned between the pair of diverter rolls such that a portion of the diverter wedge extends into the common swipe path. Positioning the diverter wedge in the common swipe path of the diverter rolls allows for increased control over signatures traveling through a folder as compared to prior known apparatus and methods thereby allowing for greater operational speeds, decreasing signature damage, less ink offset to the diverter wedge and reducing jamming tendencies in a folder.

In another embodiment of the present invention, a sheet diverter for diverting signatures delivered from a printing press to a selected one of a plurality of collation paths is provided. The sheet diverter includes an oscillating diverter device for directing a leading edge of a signature to one of the plurality of collation paths. The sheet diverter also includes a diverter which separates the plurality of collation paths for deflecting a signature to a selected one thereof. The oscillating diverter device and the diverter are capable of intermeshing at appropriate times so as to increase control over signatures traveling through a folder as compared to prior known apparatus and methods thereby also allowing for faster operational speeds, decreasing signature damage, less ink offset and reducing jamming tendencies in a folder.

In yet another embodiment of the present invention, a method for collating signatures delivered from a high speed printing press is provided. A signature is delivered to a pair of oscillating diverter rolls which generally translate over a reciprocable path which is generally normal to the path of the signatures. The translation of the diverter rolls with respect to a diverter wedge positioned therebetween is such that damage to the signatures is substantially minimized or prevented as the signatures travel to and past the diverter wedge thereby allowing for increased operating speeds with fewer jams. The translation of the diverter rolls is properly timed or adjusted with respect to the approach or position of the signatures in relation to the diverter rolls.

Accordingly, it is a feature of the present invention to provide an apparatus and a method thereof that minimizes the potential for damage to signatures as they travel down one of a plurality of collation paths, while also allowing for increased operating speeds.

Another feature of the present invention is to provide a sheet diverter in a printing press operation that provides for improved collation of signatures therethrough while eliminating the need for expensive, complicated equipment as is currently used in the industry. Thus, a feature of the invention is to provide a simple, inexpensive device to improve the collation process in a sheet diverter of a printing press and folding operation.

Yet another feature of the present invention is to provide a diverter in a printing press capable of operating at excessive speed, e.g., in excess of 2,500–3,000 fpm and above, and yet also capable of producing signatures of acceptable quality standards, while at the same time reducing jams which would normally occur in prior known devices if such devices were operated at the contemplated rates of speed discussed herein, all of which thereby minimizes machine downtime and repair expenses, and increases product output over a specified period of time.

Other features and advantages of the invention will become apparent to those skilled in the art upon review of the following detailed description, claims and drawings.

Figure 1:
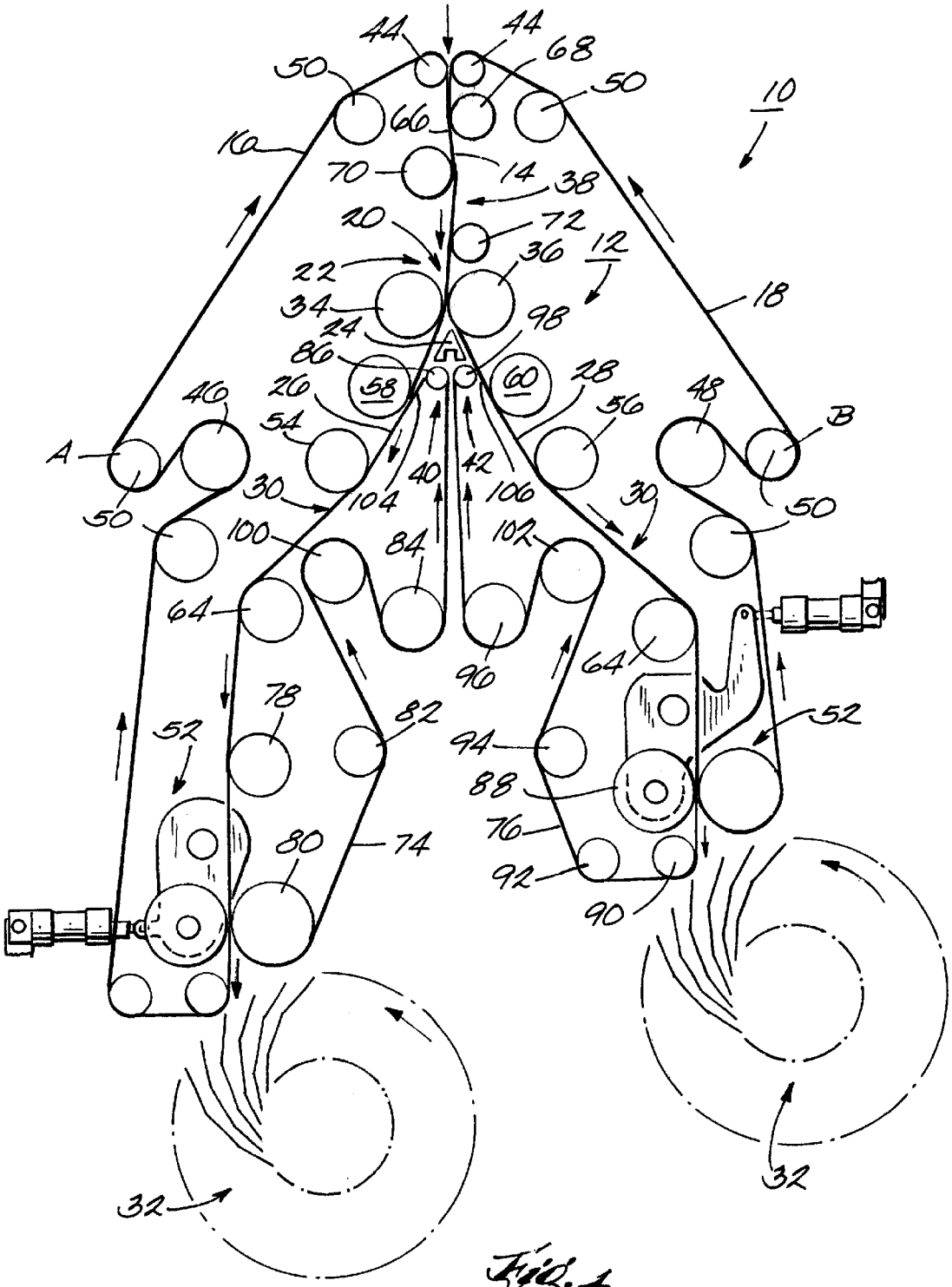
FIG. 1 is a partial schematic diagram of a pinless folder incorporating a sheet diverter in which the present invention may be employed.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DETAILED DESCRIPTION OF THE PREFERRED EMBODIMENTS

Illustrated in FIG. 1 of the drawings is a partial schematic diagram of a pinless folder 10 which is a portion of a high speed printing press (not shown). A typical folder includes a forming section, a driving section, a cutting section, a diverting section and a collating section. The invention described herein is primarily directed to a diverter section. A description of a typical forming section, driving section, cutting section, and collating section is found in U.S. Pat. No. 4,729,282, which has been incorporated herein by reference. Shown in FIG. 1, among other things, is a diverter section 12 in which the present invention may be employed.

Upstream of the diverter section 12 shown in FIG. 1, a forming section, such as that described in the '282 patent, may be provided which may include a generally triangularly shaped former board which receives a web of material (or several longitudinally slit sections of the web termed "ribbons", wherein the ribbons are typically aligned one on top of the other) and folds the same. The fold is in a direction parallel to the direction of web travel. The folded web is then fed downwardly through a drive section and a cutting section in like manner as that also described in the '282 patent.

Once the web has been transformed into a plurality of individual signatures, successive signatures enter the diverter section 12 along a diverter path 14. The signatures are led serially via opposed tapes or belts 16 and 18 to a sheet diverter 20, which includes an oscillating diverter device 22 and a diverter 24. The diverter assembly 20 deflects a signature to a selected one of a plurality of collation paths 26 or 28. The signature then enters a collating section 30 and is transported along one of the collation paths to a destination such as a fan delivery device 32 and subsequently to a conveyor (not shown), such as a shingling conveyor, as is known in the art.

The diverter device 22 of the sheet diverter 20 includes a pair of oscillating counter-rotating diverter idler rolls 34 and 36 eccentrically located on driven counter-rotating shafts. The diverter device 22 operates to direct the lateral disposition of the leading edge of a signature relative to the diverter 24 which separates the two collation paths 26 and 28. The diverter device 22 generally reciprocates in a diverter plane which has a component generally perpendicular to the diverter path 14.

Signatures are routed through the diverter path 14 and to a selected one of the collation paths 26 or 28 under the control of a signature controller means including a primary signature controller 38 and secondary signature controllers 40 and 42. Preferably, the distance through the sheet diverter 20 between the primary signature controller 38 and respective secondary signature controllers 40 and 42 is less than the length of the signature to be diverted. In this way, the selected secondary signature controller 40 or 42 assumes control of the leading edge of a signature before the primary signature controller 38 releases control of the trailing edge of the same signature. As used herein, the leading edge or end and trailing edge or end refer to the first or last inch or so of a signature length, but, may actually be as much as the first or last three inches or so of a signature length.

The primary and secondary signature controllers 38, 40 and 42 comprise opposed (face-to-face) belts or tapes 16 and 18 disposed over rollers in endless belt configurations. The primary signature controller 38 includes the first diverter belt 16 and the second diverter belt 18 which circulate in separate continuous loops in the directions shown by the arrows in FIG. 1 and are joined at a nip between a set of idler rollers 44 near the outfeed of a cutting section (not shown), as such is described in the '282 patent. Drive rollers 46 and 48 drive the diverter belts 16 and 18 respectively about, among other certain components in the separate continuous loops, idler rollers 44, a plurality of idler rollers 50, signature slow down mechanisms 52, idler rollers 54 and 56, and idler rollers 58 and 60. The diverter belts 16 and 18 are also driven around idler guide rollers 64. Both diverter belts 16 and 18 are driven by respective drive rollers 46 and 48 at the same speed, which typically is from 8% to 15% faster than the speed of the printing press. The faster speed of the belts 16 and 18 causes a gap to occur between successive signatures as the signatures move serially and in tandem down path 14 between the diverter belts 16 and 18. Preferably, for a signature having a length of about 10.875 inches, the gap between successive signatures is approximately between about 1 to 2 inches. Signatures travel generally vertically downward past the diverter 24 along collation paths 26 and 28 so that the signatures are bent as little as possible to avoid damage due to wrinkles at the backbone of the signature and to reduce tail whip of the signatures.

Located downstream of idler rolls 44 is a soft nip 66 defined by an idler roller 68 and an abaxially disposed idler roller 70. The rollers 68 and 70 cause pressure between diverter belts 16 and 18 as these belts follow the diverter path 14 through the soft nip 66. The soft nip 66 compressively captures and positively drives a signature that passes therethrough. The primary signature controller 38 includes an idler guide roll 72 which, with the aid of diverter belts 16 and 18, helps direct a signature to the oscillating diverter device 22. A soft nip, similar to soft nip 66, is defined between idler roll 70 and the abaxially disposed roller 72.

The secondary signature controllers 40 and 42 include a first collator belt 74 and a second collator belt 76, respectively, which both circulate in separate continuous loops in the directions shown by the arrows in FIG. 1. The opposed collator belts 74 and 76 share common paths with the diverter belts 16 and 18 along the collation paths 26 and 28, beginning downstream of the diverter 24. In particular, collator belt 74 is transported around idler rollers 64 and 78, roll 80 of the respective signature slow down mechanism 52, idler roller 82, drive roll 84 and idler roll 86. Collator belt 76 is transported around idler roller 64, snubber roller 88 of the respective signature slow down mechanism 52, idler rollers 90, 92, 94, drive roll 96 and idler roll 98. Idler rollers 100 and 102 also define the paths of the collator belts 74 and 76. Idler rolls 82 and 94 are belt take-up rolls and are operable to adjust the tension in each belt loop. The tension of diverter belts 16 and 18 can also be adjusted with belt take-up rollers A and B, which are connected via a pivotable lever arm to an air actuator (not shown) that applies adjustable pressure. Since the tension in all four belts can be adjusted, adjustable pressure between opposed belts results to positively hold and transport signatures at tape speeds. Belts 16 and 18 are driven at the same speed as are belts 74 and 76 through the use of timing belts and timing pulleys (not shown).

The secondary signature controller 40 includes a soft nip 104 defined by idler roller 58 operating with the abaxially disposed idler roller 86, the diverter belt 16, and the collator belt 74. Similarly, the secondary signature controller 42 includes a soft nip 106 defined by idler roller 60 operating with the abaxially disposed idler roller 98, the diverter belt 18, and the collator belt 76.

Figure 2:
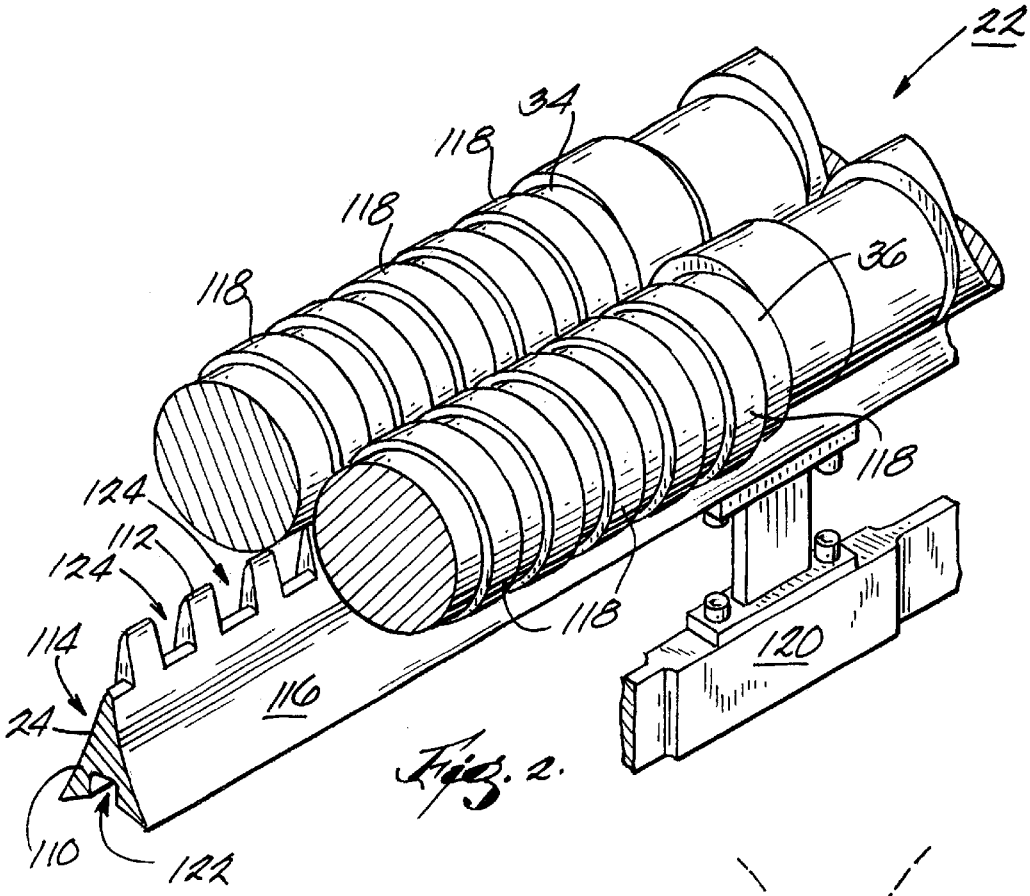
FIG. 2 is a partial perspective view of portions of a sheet diverter according to the present invention.
Figure 9:
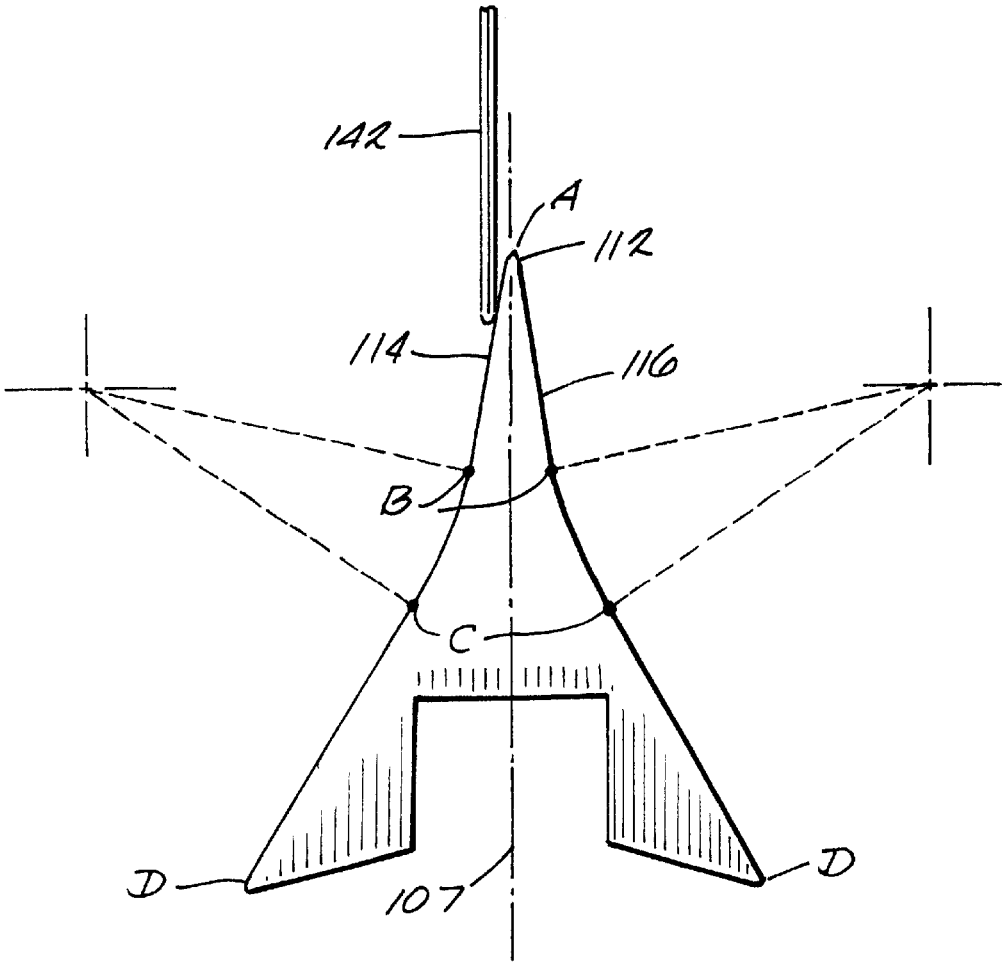
FIG. 9 is an illustrative view of a sheet diverter wedge of a sheet diverter according to yet another embodiment of the present invention.

Shown in FIG. 2 are parts of a sheet diverter according to one embodiment of the present invention. Shown are the diverter device 22 and diverter 24. The diverter rolls 34 and 36 of the diverter device 22 include outwardly extending, spaced apart, preferably crowned, steps 118, the function and purpose of which will be explained below. The diverter or diverter wedge 110 mounts to fixture 120 which is appropriately placed stationary in a folder so as to properly locate and firmly support diverter wedge 110 with respect to diverter rolls 34 and 36. The diverter wedge 110 includes diversion surfaces 114 and 116 diverging from a top vertex 112 to a base 122 which is opposite the top vertex 112. A diverter nip plane 107 is generally parallel with the diverter nip path 14 (FIG. 1) and extends through the top vertex 112 to the middle of the base 122 (see FIG. 9). With reference to FIG. 9, one embodiment of a diverter wedge is shown.

Various points A–D are identified on the diversion surfaces 114 and 116 of the diverter wedge 110. From points A to B, the diversion surfaces 114 and 116 preferably diverge from the top vertex edge 112 at approximately fifteen degrees with respect to the diverter nip plane 107 defining steeply sloped straight surfaces. From points B to C, the diversion surfaces 114 and 116 include generally curved surfaces, preferably having about a three-inch radius. From points C to D, the diversion surfaces 114 and 116 define generally straight surfaces which lead into the respective collating sections and directly into respective soft nips 104 and 106. The top vertex 112 of the diverter wedge 110 preferably includes a generally rounded surface. The top vertex 112 further includes spaced apart grooves 124 (FIG. 2). As shown in FIG. 2, grooves 124 mesh with adequate clearance with steps 118 of rolls 34 and 36, the function and purpose of which will be explained below.

Figure 8:
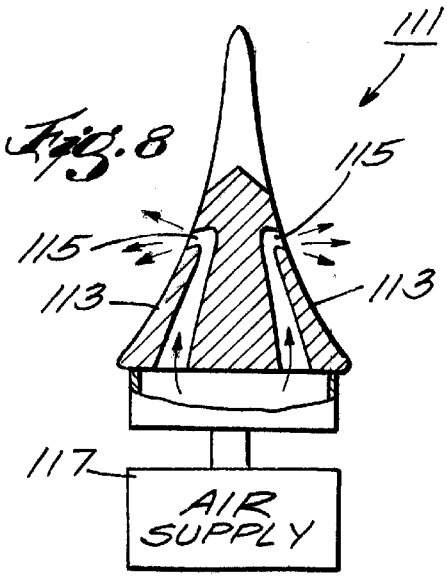
FIG. 8 is a cross section side view of a diverter wedge of a sheet diverter according to another embodiment of the present invention.

An alternative embodiment of a diverter wedge is shown in FIG. 8. Diverter wedge 111 is similar to diverter wedge 110 except that diversion surfaces 113 include respective air discharge ports 115 which are connectable to a source of pressurized air 117. The air pressure can be adjusted with external air pressure regulators or needle valves, known to those skilled in the art. Ports 115 are preferably evenly spaced holes extending through the diversion surfaces 113 in the diverter wedge 111. The air directed through the diversion surfaces 113 assists in sending the signatures down the collation paths by ensuring that the signatures do not stick to and are not appreciably slowed down by the diversion surfaces of the wedge by reducing friction between the diversion surfaces 113 and the signatures.

Figure 3:
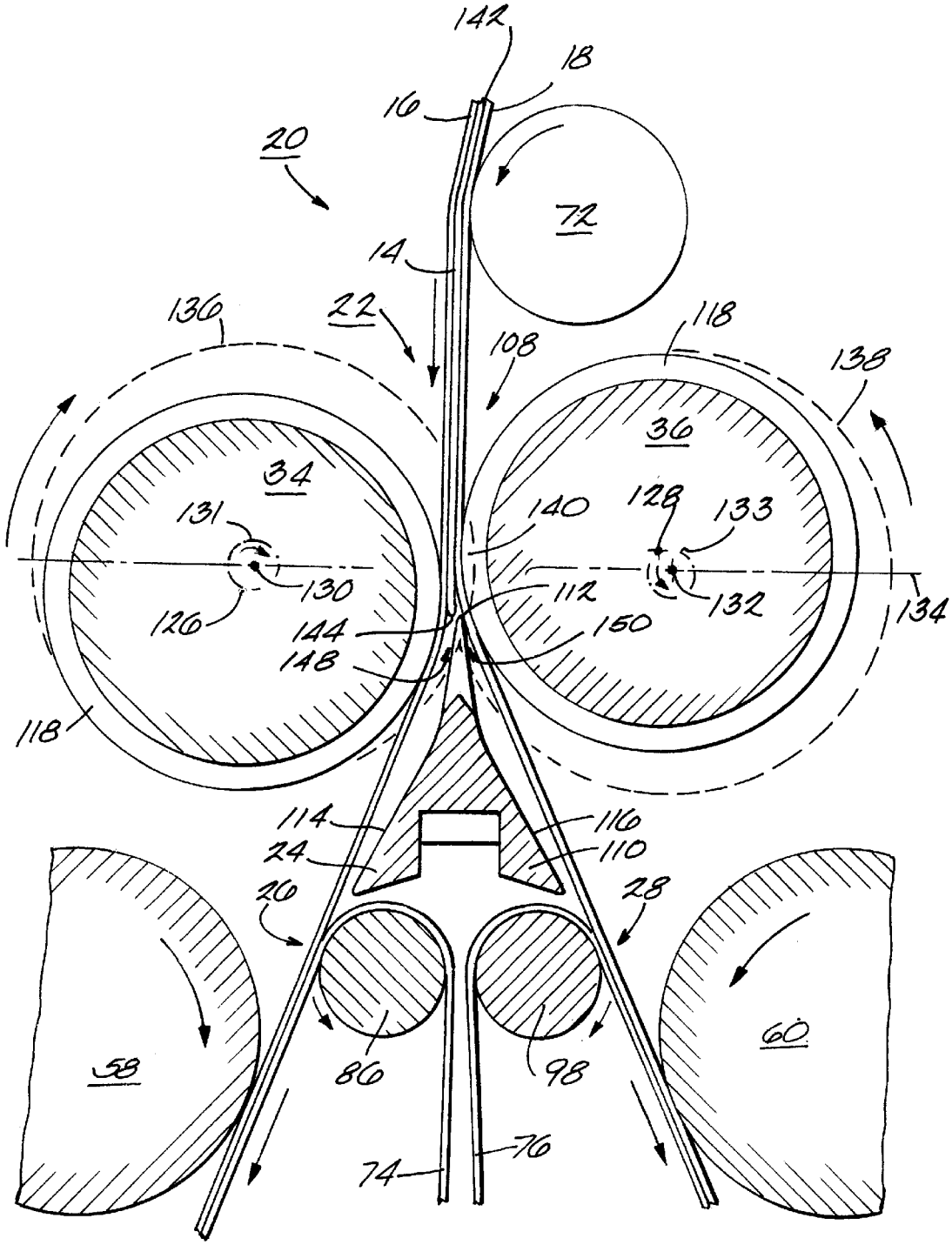
FIGS. 3–5 are cross section side views of a sheet diverter according to the present invention showing the advancement of a signature past a diverter as the signature travels to a selected one of a plurality of collation paths.
Figure 4:
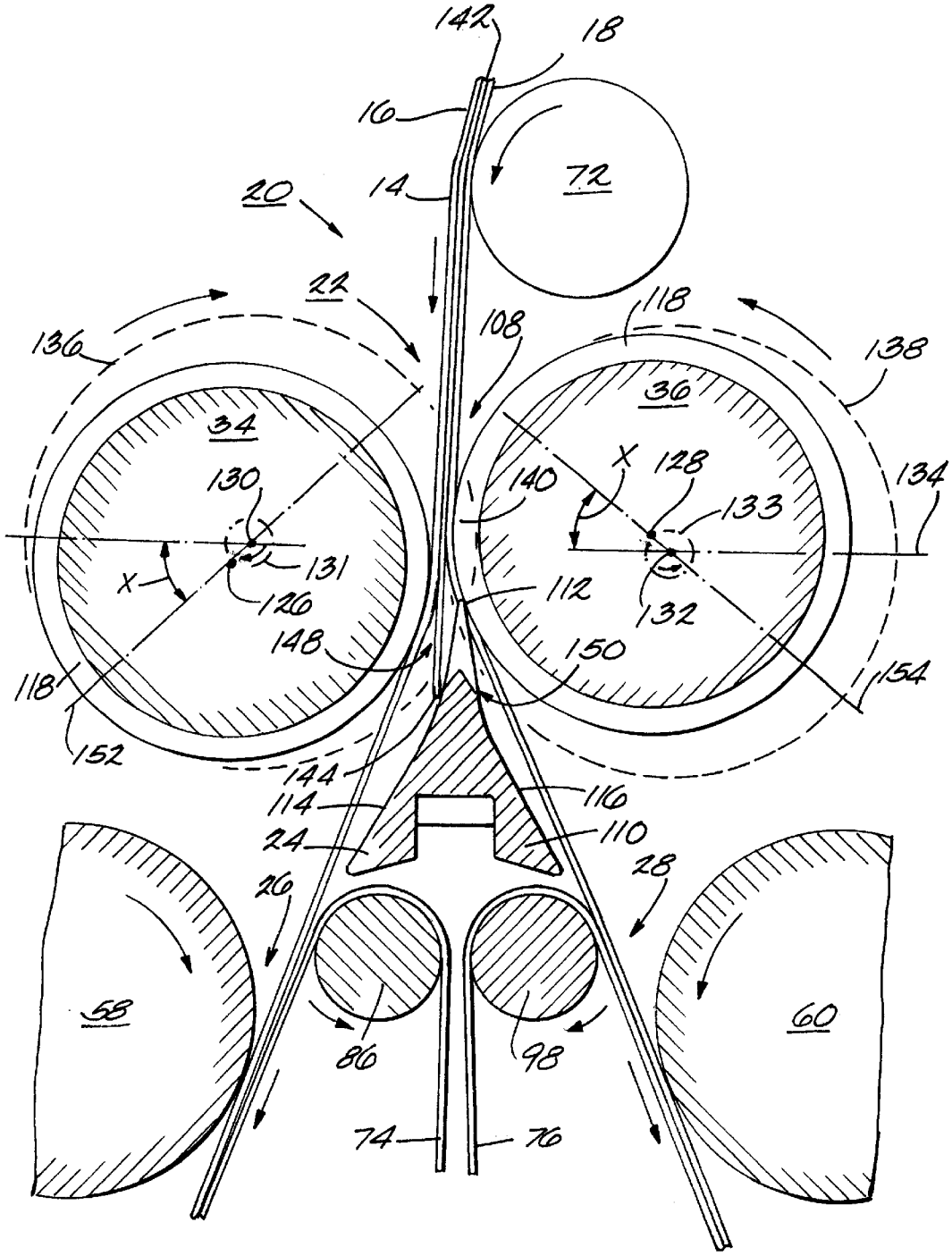
Figure 5:
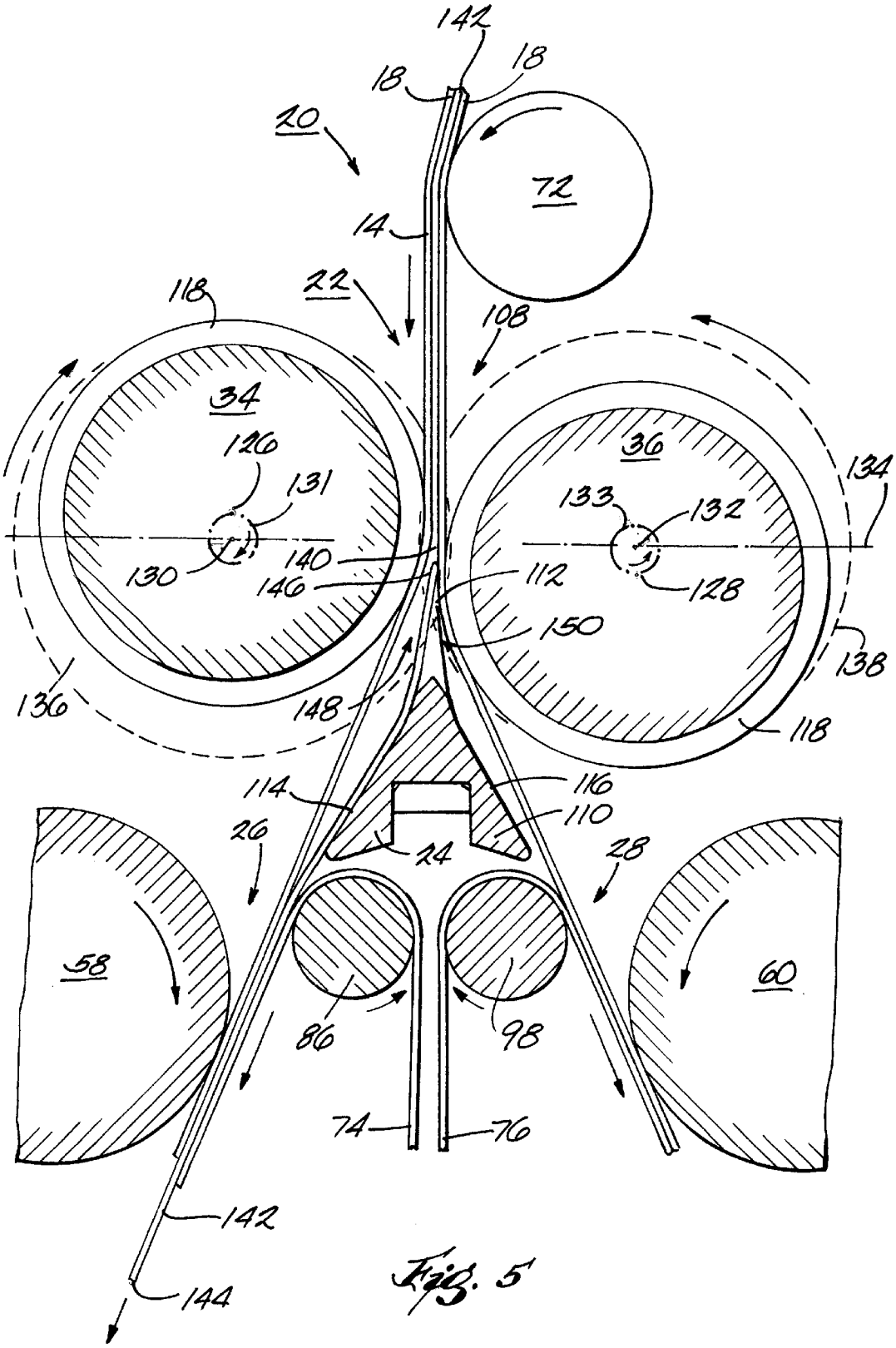

FIGS. 3–5 show the advancement of a signature past a diverter as the signature travels to a selected one of a plurality of collation paths. The gap of the nip 108 located between the belts 16 and 18 and respective diverter rolls 34 and 36 is preferably dimensioned to be oversized as compared to signature thickness to avoid exerting virtually any compressive force on a signature traveling through the sheet diverter 20 in the sense that a signature can be drawn through the nip 108 without rotation of the rolls 34 and 36. In operation, at least a first and second diverter belt 16 and 18 carry individual signatures toward the sheet diverter 20 (FIG. 1). As the diverter rolls 34 and 36 oscillate and translate, as a result of being eccentrically located about driven counter-rotating shafts, the diverter nip 108 moves from one side to the other side of the diverter wedge 110. A first signature is guided along one diversion surface 114 of the wedge 110. As the signature moves through the nip 108, the diverter rolls 34 and 36 continue to oscillate and translate so that nip 108 moves to the other side of the wedge 110. In this manner, a successive signature is diverted to the other side of the wedge 110 along the diversion surface 116.

The diverter rolls 34 and 36 include roll centers 126 and 128. The diverter rolls 34 and 36 rotate about their respective centers and are caused to do so by virtue of being in contact with respective belts 16 and 18. The diverter rolls 34 and 36 are also journalled for rotation about respective axes 130 and 132 lying in a diverter plane 134 which has a component generally normal to the diverter path 14 of the signatures. Axes 130 and 132 extend lengthwise through the respective rolls 34 and 36. Preferably, the diverter rolls 34 and 36 are eccentrically located upon respective driven shafts 131 and 133 wherein the axes 130 and 132 lying in the diverter plane 134 extend through respective centers of the shafts. More preferably, each of the eccentrically located diverter rolls 34 and 36 is designed to be approximately one-quarter inch of the axis of the respective shafts, to yield a full eccentric throw of about one-half inch.

It should be noted that in a printing press operation such as that described in reference to FIG. 1, two or more collating sections having a plurality of collating paths may be provided. As shown in FIGS. 2–5, diverter rolls 34 and 36 cooperate with collation paths 26 and 28. Although not shown in FIG. 2, a second sheet diverter, comprising a mirror image of sheet diverter 20, may be provided adjacent to sheet diverter 20. In such an arrangement, more than two collation paths are used to assemble magazines or the like.

Figure 6:
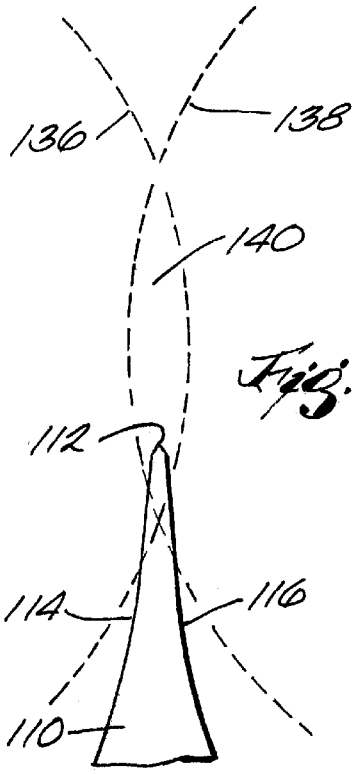
FIG. 6 is an enlarged view of a portion of the sheet diverter shown in FIGS. 3–5.

Referring again to FIGS. 3–5, it can be appreciated that as the diverter rolls 34 and 36 rotate about their own axis 126 or 128, the roll centers 126 and 128 are caused to orbit about the respective shaft centers 130 and 132. The orbital motion of the diverter rolls 34 and 36 defines travel paths of the outside diameters of steps 118 for each of the diverter rolls as identified by dotted lines 136 and 138. As shown, travel paths 136 and 138 partially overlap to define a common swipe path 140, best seen in FIG. 6, the significance of which will be explained below. The diverter wedge 110, separates the collation paths 26 and 28 and is interposed between the diverter rolls 34 and 36 such that a portion of the diverter wedge 110 extends into the common swipe path 140 (see also FIG. 6).

Figure 7:
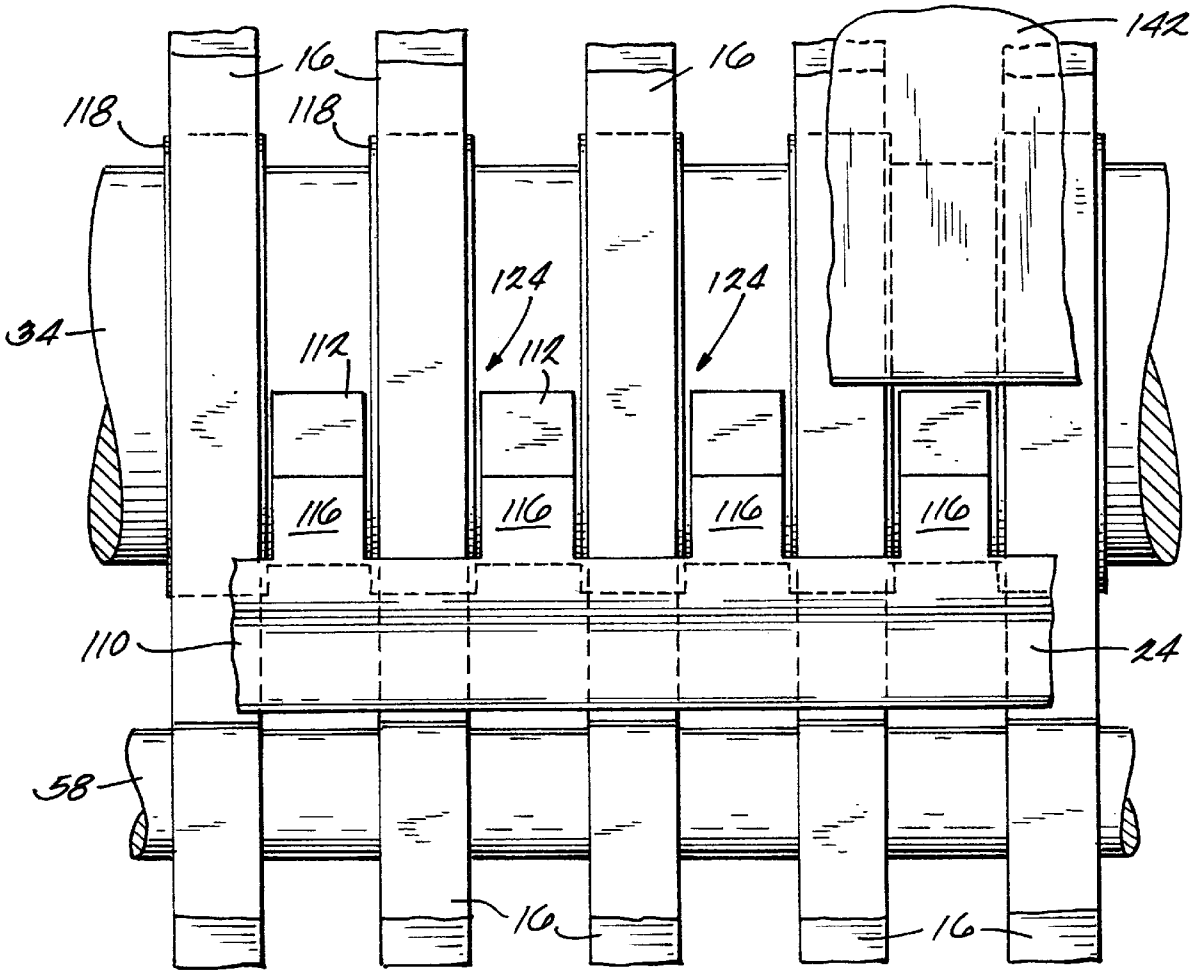
FIG. 7 is a front view of a sheet diverter of the present invention with one diverter roll removed showing the relationship between certain components of the sheet diverter.

The sheet diverter 20 of the present invention routes a signature 142 to an appropriate one of the collation paths 26 or 28 by placement of the leading edge 144 of that signature into appropriate proximate contact with the diverter 24. In the illustrative embodiment, the diverter wedge 110 is orientated toward the diverter nip 108 and the diversion surfaces 114 and 116 taper downwardly from the apex 112 toward the collation paths 26 and 28. The belts 16 and 18 are preferably a part of a separate group of segmented belts. With reference to FIG. 7 in conjunction with what is shown in FIG. 2, it can be observed that the belts 16 and 18 are in operative engagement with respective rolls 34 and 36. Preferably, for every step 118 of rolls 34 and 36, a separate belt is in operative engagement with that step. The steps 118 are generally crowned to assist in tracking of the belts as they traverse over the steps. The belts 16 and 18 diverge from a point intermediate the diverter rolls 34 and 36 and the diverter wedge 110 along distinct collation paths. The belts 16 and 18 confine a signature 142 therebetween for transport to the diverter wedge 110 such that the signature does not come into contact with either of the diverter rolls 34 or 36.

With continued reference to FIGS. 3–5, signature passageways 148 and 150 are formed between respective diversion surfaces 114 and 116 of the diverter wedge 110 and the respective diverter belts 16 and 18. As the diverter device 22 reciprocates in the diverter plane 134, the leading edge 144 of the signature 142 is caused to enter one or the other of the signature passageways 148 or 150. The diverter belts, diverter rolls and diverter wedge are cooperatively arranged so as not to substantially hinder or pinch a signature as the signature travels down a diverter path, past a diverter to a selected one of a plurality of collation paths.

FIG. 3 shows the leading edge 144 of a signature 142 approaching the top vertex 112 of wedge 110. As shown, diverter rolls 34 and 36 are positioned along their respective travel paths 136 and 138 so as to direct the leading edge 144 of the signature to one side of the diverter wedge 110. The timing of the translation of the diverter rolls 34 and 36 is such that the leading edge 144 of the signature 142 will not contact the apex 112 of the diverter 110 which, if it did occur, may damage the leading edge of the signature and could cause a jam in the diverter.

As is apparent in FIG. 3, passageway 148 is open and passageway 150 is practically closed. Passageways 148 and 150 tend to open and close as the diverter rolls 34 and 36 reciprocate in the diverter plane 134. In prior designs, at excessive speeds, because of the relationship between the diverter rolls and the diverter wedge, a signature could be directed down a wrong collation path as a result of passageways on either side of a diverter wedge not being sufficiently closed. As shown in FIG. 3, because the diverter wedge reaches into the common swipe path 140 of the diverter rolls 34 and 36, and because the rolls 34 and 36 translate in a reciprocable path, the passageway 150 is sufficiently closed to prevent the signature 142 from being directed down the wrong collation path, in this case, collation path 28.

FIG. 4 shows the leading edge 144 of signature 142 as the signature is first guided into initial contact with the diverter wedge 110. The top vertex 112 and diversion surfaces 114 and 116 of the diverter 24 are designed as set forth above to ease the passage of the signatures along the collation paths. The vertex 112 is preferably rounded to assist in reducing damage to the leading edge or trailing edge of a signature if such should contact the vertex 112. The upstream portion of the diversion surfaces 114 and 116 are steeply sloped and liberally curved (FIG. 9) to reduce the impact force acting on the leading edge 144 of the signature 142 as it strikes against the diverter wedge 110 and to reduce the rubbing pressure on the side of the signature which travels against the diverter wedge so as to prevent or reduce ink offset. The signature 142 is continually advanced along collation path 26 as rolls 34 and 36 rotate and translate. As can be observed in FIG. 4, with reference to FIG. 6, steps 118 of roll 36 extend beneath diversion surface 116 of wedge 110 during part of the full rotation such that diverter roll 36 meshes with diverter wedge 110. The steps 118 mesh with grooves 124 of wedge 110 so as not to cause damage from a collision to the diverter roll 36 and diverter wedge 110. The meshing action between the diverter roll 36 and diverter wedge 110 allows the diverter wedge 110 to extend into the common swipe path 140 of the diverter rolls 34 and 36. As noted, control over the signature is increased by placing the diverter wedge 110 in the common swipe path 140 of the diverter rolls 34 and 36.

FIG. 5 shows the trailing edge 146 of the signature 142 as it approaches the apex 112 of diverter wedge 110. As the diverter rolls 34 and 36 translate along plane 134, passageway 148 is closing and passageway 150 is opening. The translation of the rolls 34 and 36 is such that the trailing edge 146 of the signature will not be slapped violently against the vertex 112 which would cause tailwhip. This is prevented because the diverter wedge 110 reaches into the common swipe path 140. The signature 142 is more fully supported as the belts 16 and 18 diverge from the rolls 34 and 36. In prior sheet diverters, the diverter wedge may be located substantially distant from the diversion point of the belts. Thus, in such prior designs, a significant portion, including the trailing edge, of a signature may be whipped against and across the top vertex of the diverter wedge thereby damaging the trailing edge as set forth above.

Timing the translation of the diverter rolls to the arrival time of the signatures as the signatures are collated from a high speed printing press is one aspect of the present invention. The timing of the translation, which may be manual, semi-automatic or automatic, should be controlled such that when a leading edge of a signature is adjacent to an uppermost portion of a diverter, the diverter rolls direct the leading edge of the signature to one side of the diverter so that the signature leading edge does not contact the top vertex. Moreover, timing the translation of the diverter rolls should be such that the trailing edge of the signature will not whip against the top portion of the diverter as the signature continually travels along the selected collation path.

With reference to FIG. 4, a preferred embodiment of the invention will be described. The timing of the translation of diverter rolls 34 and 36 is preferably based on the point in time when the leading edge 144 of the signature 142 first contacts a diversion surface of the diverter wedge 110. As previously explained, roll centers 126 and 128 are caused to orbit about respective axes 130 and 132. Position "X" is defined as the angular location of the centers 126 and 128 of diverter rolls 34 and 36 with respect to axes 130 and 132 and plane 134 when the signature first contacts the wedge 110. In position "X", it can be observed that roll center 126 is located to the left and below axis 130 and roll center 128 is located to the left and above axis 132. Diverter roll 34 is located about its travel path 136 in the position shown such that roll center 126 falls on a plane 152 traveling through roll center 126 and axis 130, the plane 152 being set at a preferred angle of between about 25–45 degrees with respect to plane 134. Diverter roll 36 is located about its travel path 138 in the position shown such that roll center 128 falls on a plane 154 traveling through roll center 128 and axis 132, the plane being set at a preferred angle of between about 25–45 degrees with respect to plane 134. Preferably, the numerical angle value for locating roll 34 with respect to plane 152 and plane 134 is equal to the numerical angle value for locating roll 36 with respect to plane 154 and plane 134.

Timing the translation and positioning of rolls 34 and 36 as set forth with respect to FIG. 4 ensures that as a leading edge of a signature approaches apex 112 (FIG. 3), the leading edge will not sufficiently contact or sufficiently misses the vertex 112 and the signature 142 will not be directed down the wrong collation path 28. As shown in FIG. 3, rolls 34 and 36 have not yet reached position "X" as identified in FIG. 4. However, based on the timing of the translation of the rolls in order to reach position "X", the position of the rolls 34 and 36 is timed such that passageway 150 is sufficiently closed and passageway 148 is sufficiently opened so that rolls 34 and 36 properly direct the leading edge 144 of signature 142 to collation path 26. In addition, proper timing and positioning of the rolls 34 and 36 will ensure that as a trailing edge of a signature approaches apex 112 (FIG. 5), the trailing edge will not be violently whipped or slapped against or across the apex 112. As shown in FIG. 5, rolls 34 and 36 have translated beyond position "X" as described in FIG. 4. The translation of the rolls 34 and 36 is timed such that passageway 148 is closing and passageway 150 is opening so that signature 142 is properly directed down collation path 26 and a succeeding signature will be fed down collation path 28.

It should be noted that for every 180 degrees the drive shafts rotate, one signature travels past the rolls. Thus, with reference to FIGS. 3–5, and particularly the just described preferred embodiment, when a succeeding signature is directed to collation path 28 and the signature contacts a surface 116 of a wedge 110, the location of rolls 34 and 36 will be reversed with respect to the description related to FIG. 4.

The operation of the present invention may be further explained as follows. As described, when the diverter rolls 34 and 36 translate over a path in the diverter plane 134 in order to direct a signature 142 to a wedge 110, passageways 148 and 150 tend to open and close. As illustrated in FIG. 4, when the signature 142 contacts the wedge 110, grooves 124 in wedge 110 mesh with sufficient clearance with steps 118 of roll 36. It should be noted that although the steps 118, and thereby belts 18, extend beneath diversion surface 116, the belts 18 preferably do not contact any part of wedge 110 because such contact may cause the belts to adversely wear. As is apparent with reference to FIG. 5, as a succeeding signature is directed to collation path 28, grooves 124 in wedge 110 will appropriately mesh with sufficient clearance with steps 118 of roll 34. In this way, the grooves 124 intermittently mesh with steps 118 of rolls 34 and 36. It should be noted that the timing of the translation and thereby the meshing action of the rolls and wedge is such that the signatures are not hindered or pinched as they travel from the diverter path to the collation paths. As should be evident, if a roll, such as roll 34, meshes with grooves 124 in the wedge 110 before a signature has traveled past the apex 112 on its way down the collation path 26, the signature would be pinched between the belts 16 and wedge 110 thereby causing damage to the signature and possibly jamming the machine.

Figure 10:
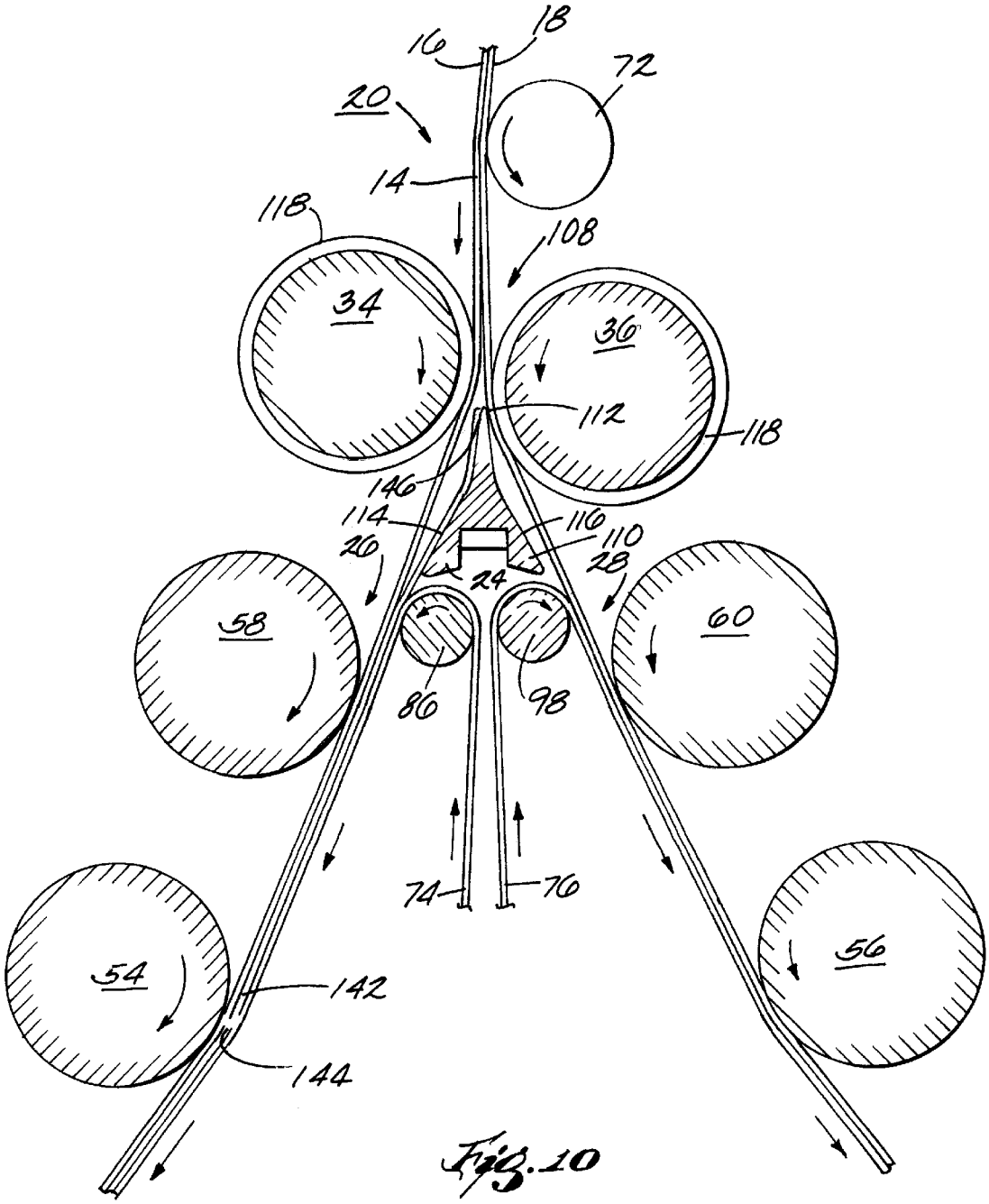
FIG. 10 is an illustrative view of the sheet diverter of FIG. 1 showing in greater detail another aspect of the present invention.

FIG. 10 is an illustrative view of the sheet diverter of FIG. 1 showing in greater detail another aspect of the present invention. As a signature 142 is traveling past a diverter wedge 110 in a diverter section, it is desirable to prevent the signature 142 from being bent in more than one direction so as to reduce tail whip of the trailing edge 146 of the signature 142 as it travels past the vertex 112 of the diverter wedge 110. As such, from the point the diverter belts 16 and 18 generally release from respective diverter rolls 34 and 36 to the point the diverter belts 16 and 18 generally engage respective rolls 54 and 56, the diverter belts 16 and 18 travel in a substantially straight line. The distance between these two points is approximately equal to about the length of one signature. In this way, as a signature 142 travels down one of the collation paths 26 or 28, the leading edge 144 of a signature 142 will not be directed in another direction until the trailing edge 146 of the signature 142 has traveled past the apex 112 of the diverter 24. Thus, reducing the likelihood that the trailing edge 146 will be violently whipped against or across the apex 112 of the diverter 24. In order to achieve the foregoing features, idler rollers 58 and 60 are adjustable generally perpendicular to the respective belt or collator paths 26 or 28 and idler rollers 54 and 56 are adjustable generally parallel to the respective belt or collator paths 26 or 28.

It is readily apparent from the foregoing detailed description that the sheet diverter of the present invention overcomes the problems of the prior art. The sheet diverter of the present invention may function efficiently in conjunction with a high speed printing press at sheet speeds in excess of 2,500–3,000 fpm or more. Sheets are efficiently diverted into appropriate collation paths at these high speeds with reduced damage to the sheets and with reduced jamming tendencies. Anticipating the occurrences of such jams, which although reduced in tendency could never be made non-existent, the diverter rolls may be designed to pivot away from each other through the use of air cylinders or the like in order to open up a region near the collation paths and diverter so jammed product can be removed. Thus, even in the event of jams, the downtime associated with clearing the apparatus is greatly reduced.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A diverter assembly for diverting signatures that are received from a printing press along a single feed path, said diverter assembly comprising:

a diverter wedge having a pair of sides and positioned such that each successive signature travels along opposing sides of the diverter wedge;

a pair of diverter belts oriented in face to face relation and transporting signatures toward the diverter wedge; and a pair of collation paths, wherein one of the collation paths is positioned on one of the sides of the diverter wedge and the other of the collation paths is on the opposing side of the diverter wedge, each of the collation paths includes a substantially straight portion that is positioned to receive signatures from a respective side of the diverter wedge, the straight portion having a length that is at least equal to a length of the signatures.

2. The diverter assembly of claim 1, and further including a pair of diverter rolls that receive signatures therebetween.

3. The diverter assembly of claim 1, wherein the diverter wedge is substantially triangular in cross section.

4. A diverter assembly for diverting signatures that are received from a printing press along a single feed path, said diverter assembly comprising:

a diverter wedge having a pair of sides and positioned such that each successive signature travels along opposing sides of the diverter wedge;

a pair of diverter belts oriented in face to face relation and transporting signatures toward the diverter wedges;

a pair of collation paths, wherein one of the collation paths is positioned on one of the sides of the diverter wedge and the other of the collation paths is on the opposing side of the diverter wedge, each of the collation paths including a substantially straight portion that is positioned to receive signatures from a respective side of the diverter wedge, the straight portion having a length that is at least equal to a length of the signatures; and, a pair of diverter rolls that receive signatures therebetween, wherein each of the pair of diverter rolls has a central axis, and is rotatable about a mounting axis located a distance from the central axis such that the roll central axis orbits the mounting axis and the roll eccentrically rotates, and wherein the pair of rolls eccentrically rotate between a first diverting orientation and a second diverting orientation such that when in the first diverting orientation, signatures are diverted to the first collation path, and when in the second diverting orientation, signatures are diverted to the second collation path.

5. The diverter assembly of claim 1, wherein one side of the diverter wedge is in selective communication with the single feed path for the receipt of signatures, and is in communication with the first collation path for the delivery of signatures thereto, and wherein the opposing side of the diverter wedge is in selective communication with the single feed path for the receipt of signatures, and is in communication with the second collation path for the delivery of signatures thereto.

6. The diverter assembly of claim 1, further comprising a first pair of belts defining at least a portion of the first collation path, and a second pair of belts defining at least a portion of the second collation path wherein each pair of belts at least partially define the substantially straight portion of the respective collation paths, and wherein each pair of belts are arranged in a face-to-face relationship for the receipt of signatures therebetween.

7. The diverter assembly of claim 6, wherein the pair of diverter belts includes one belt of the first pair of belts and one belt of the second pair of belts, and wherein the pair of diverter belts at least partially defines the single feed path.

8. The diverter assembly of claim 1, further comprising first and second idler rollers, the idler rollers partially defining the entrance to the first and second collation path, wherein the idler rollers are positioned such that signatures entering the first collation path will enter substantially tangent to the first idler roller and signatures entering the second collation path will enter substantially tangent to the second idler roller.

9. A diverter assembly for diverting signatures that are received from a printing press along a single feed path, the diverter assembly comprising:

a diverter wedge positioned to receive signatures from the single feed path;

a pair of diverter belts oriented in face to face relation and transporting signatures toward the diverter wedge; and a pair of collation paths, each path including a substantially straight portion positioned to receive a signature from the diverter wedge, the substantially straight portion having a length that is at least equal to the length of the signatures, wherein the diverter wedge selectively diverts successive signatures from the single feed path to one of the pair of collation paths.

10. The diverter assembly of claim 9, further comprising a pair of diverter rolls that receive signatures therebetween, the diverter rolls each having a central axis and together defining a portion of the single feed path.

11. A diverter assembly for diverting signatures that are received from a printing press along a single feed path, the diverter assembly comprising:

a diverter wedge positioned to receive signatures from the single feed path;

a pair of diverter belts oriented in face to face relation and transporting signatures toward the diverter wedge;

a pair of collation paths, each path including a substantially straight portion positioned to receive a signature from the diverter wedge, the substantially straight portion having a length that is at least equal to the length of the signatures, the diverter wedge selectively diverting successive signatures from the single feed path to one of the pair of collation paths; and, a pair of diverter rolls that receive signatures therebetween, the diverter rolls each having a central axis and together defining a portion of the single feed path, wherein each of the pair of diverter rolls is rotatable about a mounting axis located a distance from the central axis such that the central axis orbits the mounting axis and each roll rotates in an eccentric, and wherein the pair of rolls eccentrically rotate between a first diverting orientation and a second diverting orientation such that when in the first diverting orientation, signatures are diverted to the first collation path, and when in the second diverting orientation, signatures are diverted to the second collation path.

12. The diverter assembly of claim 10, wherein the diverter wedge has at least one vertex disposed between the diverter rolls.

13. The diverter assembly of claim 9, wherein the diverter wedge is substantially triangular in cross section.

14. The diverter assembly of claim 9, wherein the diverter wedge has a first side and a second side, and wherein the first side is in selective communication with the single feed path for the receipt of a signature, and is in communication with the first collation path for the delivery of signatures thereto, and wherein the second side is in selective communication with the single feed path for the receipt of a signature, and is in communication with the second collation path for the delivery of signatures thereto.

15. The diverter assembly of claim 9, further comprising a first pair of belts defining at least a portion of the first collation path, and a second pair of belts defining at least a portion of the second collation path, wherein each pair of belts is arranged in a face-to-face relationship for the receipt of signatures therebetween.

16. The diverter assembly of claim 15, wherein the pair of diverter belts includes one belt of the first pair of belts and one belt of the second pair of belts, and wherein the pair of diverter belts at least partially defines the single feed path.

17. The diverter assembly of claim 15, wherein the first pair of belts at least partially define the substantially straight portion of the first collation path, and the second pair of belts at least partially define the substantially straight portion of the second collation path.

18. The diverter assembly of claim 9, further comprising first and second idler rollers, the idler rollers partially defining the entrance to the first and second collation paths, wherein the idler rollers are positioned such that signatures entering the first collation path will enter substantially tangent to the first idler roller and signatures entering the second collation path will enter substantially tangent to the second idler roller.

19. A method of diverting signatures that are received from a printing press along a single feed path, the method comprising:

positioning a diverter wedge adjacent a single feed path of signatures;

transporting the signatures along the single feed path between a pair of diverter belts;

advancing each of the signatures along the single feed path until the diverting wedge directs successive signatures in the single feed path to selectively pass by opposing sides of the diverter wedge; and advancing a leading edge of each of the signatures from the bottom of the diverter wedge in a substantially straight path until a trailing edge of the signatures has advanced past the diverter wedge.

20. A method of diverting signatures that are received from a printing press along a single feed path, the method comprising:

positioning a diverter wedge adjacent the single feed path of signatures;

providing a pair of diverter rolls, each roll having a central axis, the diverter rolls partially defining the single feed path;

mounting the diverter rolls on mounting axes spaced a distance from the central axes such that the diverter rolls rotate eccentrically between a first diverting orientation and a second diverting orientation;

transporting the signatures along the single feed path between a pair of diverter belts;

rotating the rolls to the first diverting orientation;

diverting a leading edge of one signature to a first opposing side of the diverter wedge;

advancing the leading edge of the one signature from the bottom of the diverter wedge in a substantially straight path until a trailing edge of the one signature has advanced past the diverter wedge;

continuously rotating the diverter rolls from the first diverting orientation to the second diverting orientation;

diverting a leading edge of a subsequent signature to a second opposing side of the diverter wedge;

advancing the leading edge of the subsequent signature from the bottom of the diverter wedge in a substantially straight path until a trailing edge of the subsequent signature has advanced past the diverter wedge; and continuously rotating the diverter rolls from the second diverting orientation to the first diverting orientation.

21. The method of claim 19, wherein a first pair of belts at least partially define a first collation path and a second pair of belts at least partially define a second collation path, the method further comprising:

capturing the leading edge of the diverted signature between the first pair of belts after the leading edge of the signature passes the first opposing side of the diverter wedge; and capturing the leading edge of the subsequent diverted signature between the second pair of belts after the leading edge of the signature passes the second opposing side of the diverter wedge.

* * * * *